US009687033B2

(12) United States Patent
Lillie

(10) Patent No.: US 9,687,033 B2
(45) Date of Patent: Jun. 27, 2017

(54) LEG MOBILITY ASSISTIVE GARMENT

(71) Applicant: FROG LEG MOBILITY INC., Barrie (CA)

(72) Inventor: Aaron Kayne Lillie, Barrie (CA)

(73) Assignee: FROG LEG MOBILITY INC., Barrie, Ontario (CA)

( * ) Notice: Subject to any disclaimer, the term of this patent is extended or adjusted under 35 U.S.C. 154(b) by 87 days.

(21) Appl. No.: 14/747,473

(22) Filed: Jun. 23, 2015

(65) Prior Publication Data

US 2016/0374414 A1 Dec. 29, 2016

(51) Int. Cl.
*A41D 13/12* (2006.01)
*A41D 1/06* (2006.01)

(52) U.S. Cl.
CPC ..... *A41D 13/1254* (2013.01); *A41D 1/06* (2013.01)

(58) Field of Classification Search
CPC ..... A41D 13/1254; A41D 1/06; A61F 5/40; A61F 5/0102; A61F 5/01; A63B 21/0552
USPC ..... 2/227
See application file for complete search history.

(56) References Cited

U.S. PATENT DOCUMENTS 879,534 A * 2/1908 Fraser ..... A61F 5/0096 128/882
1,670,935 A * 5/1928 Maynard ..... A63B 71/12 2/22
2,607,340 A 6/1951 Anderson
3,260,259 A * 7/1966 Connelly ..... A61F 5/0193 602/24
3,502,071 A * 3/1970 Holly ..... A61H 3/00 601/34
3,815,589 A * 6/1974 Bosley ..... A61F 5/0193 602/24
3,923,050 A * 12/1975 Zeide ..... A61F 5/3761 602/4
4,019,503 A 4/1977 Smith
4,285,069 A * 8/1981 Hall ..... A41F 11/00 2/314
4,495,941 A 1/1985 Rathvon et al.
(Continued)

FOREIGN PATENT DOCUMENTS

DE 202008002836 5/2008
WO 2011/080247 A1 7/2011
WO 2012/034561 A2 3/2012

OTHER PUBLICATIONS

Machine-generated English translation by EPO and Google, Description of DE202008002836, Kissen Zur Beinfixierung, "The present invention relates to a pillow, which results in an intermediate pad for the bent knee in a lateral sleeping posture.", May 2, 2015 (12 pages).

(Continued)

*Primary Examiner* — Clinton T Ostrup
*Assistant Examiner* — Anne Kozak

(57) ABSTRACT

An assistive garment for aiding in reorientation of the lower limbs of a wearer has a pair of trouser legs, each of which is dimensioned to encompass at least a portion of a respective lower limb of the wearer. A bridge extends between the pair of trouser legs and is joined to each leg of the pair. A handle extends from the bridge. The handle is adapted to permit manipulation of the lower limbs of the wearer by way of manipulation of the handle using at least one upper limb of the wearer.

10 Claims, 4 Drawing Sheets

(56) References Cited

U.S. PATENT DOCUMENTS 5,490,826 A * 2/1996 Rose ..... A63B 21/0004 482/124
5,558,628 A * 9/1996 Bzoch ..... A61F 5/0193 128/882
5,573,487 A * 11/1996 Wallner ..... A63B 21/0004 482/122
5,681,270 A * 10/1997 Klearman ..... A61F 5/0193 128/845
5,711,747 A * 1/1998 Steinback ..... A63B 21/0004 482/122
5,718,672 A * 2/1998 Woodman ..... A61F 5/0193 602/23
5,814,001 A * 9/1998 Schwenn ..... A61F 5/0193 602/23
5,895,366 A 4/1999 Bzoch
5,911,696 A 6/1999 Coates
6,004,282 A * 12/1999 Whitley ..... A61F 13/041 128/882
6,585,672 B1 * 7/2003 Crompton ..... A61F 5/0193 128/869
6,715,167 B2 4/2004 Wake
6,752,776 B2 * 6/2004 West ..... A61H 3/008 602/32
7,007,705 B1 * 3/2006 Thrower ..... A61H 3/00 135/65
7,334,275 B1 2/2008 Kirkwood
7,476,185 B2 * 1/2009 Drennan ..... A61F 5/0193 482/121
D588,705 S 3/2009 Cameron
D631,924 S * 2/2011 Baldwin ..... D21/662
8,321,972 B1 12/2012 Vetter
8,771,155 B1 * 7/2014 Bell ..... A63B 69/0059 482/124
D723,116 S * 2/2015 Gillespie ..... D21/662
D750,716 S * 3/2016 Pouliot ..... D21/692
2003/0195445 A1 * 10/2003 Behan ..... A61F 5/0102 602/19
2004/0049139 A1 3/2004 Craciunescu
2005/0205619 A1 * 9/2005 Morel ..... A47G 25/90 223/111
2005/0211191 A1 * 9/2005 Kleinhardt ..... A01K 15/04 119/819
2011/0072545 A1 * 3/2011 Bennett ..... A41D 13/0543 2/2.5
2011/0167532 A1 * 7/2011 Carlson ..... A41D 31/0016 2/69
2014/0207040 A1 * 7/2014 Ingimundarson ..... A61F 5/0193 602/23
2015/0351992 A1 * 12/2015 Crowley ..... A61H 1/0237 601/34

OTHER PUBLICATIONS

Machine-generated English translation by EPO and Google, Description of WO2011080247, Schodde, Helgard, "Orthosis—The invention relates to an orthopedic prosthesis, orthosis short, especially for people with spastic cerebral palsy.", Apr. 27, 2015 (10 pages).

* cited by examiner

LEG MOBILITY ASSISTIVE GARMENT

BACKGROUND

This relates to assistive garments, and more particularly to garments aiding in the control and repositioning of the lower limbs of a wearer.

For persons with no or limited mobility of their lower limbs such as, for example, persons with paraplegia, repositioning of the lower limbs can be difficult due to a lack of muscle tone and/or control. Especially when sleeping, repositioning of limbs may be important to achieving a comfortable body position. For example, some persons with no or limited control of their legs may find their legs become splayed during sleep, which may be particularly uncomfortable. Moreover, being able to reposition the limbs may assist in avoiding static sleeping positions and thereby lessen the likelihood of bed or pressure sores on the body.

SUMMARY

An assistive garment for aiding in reorientation of the lower limbs of a wearer has a pair of trouser legs, each of which is dimensioned to encompass at least a portion of a respective lower limb of the wearer. A bridge extends between the pair of trouser legs and is joined to each leg of the pair. A handle extends from the bridge. The handle is adapted to permit manipulation of the lower limbs of the wearer by way of manipulation of the handle using at least one upper limb of the wearer.

In this way, a wearer of the garment may reorient their own legs using their arms. Such a garment may also control the legs of a wearer so as to limit uncomfortable sleeping positions, such as, for example, splayed legs.

BRIEF DESCRIPTION OF THE DRAWINGS

Example embodiments are described in detail below, with reference to the following drawings.

DETAILED DESCRIPTION

Figure 1:
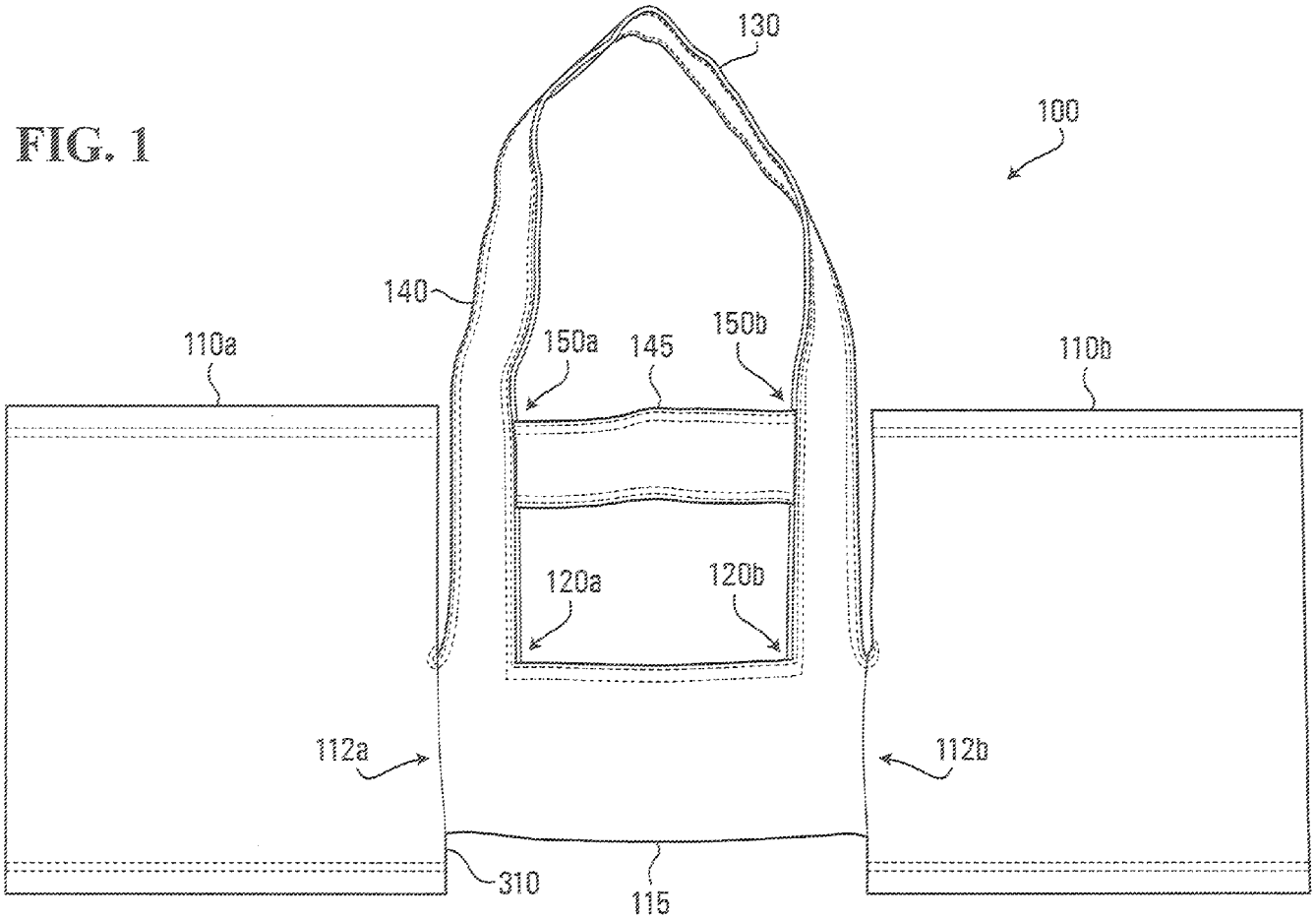
FIG. 1 is a front view of an embodiment of an assistive garment laid flat.
Figure 2:
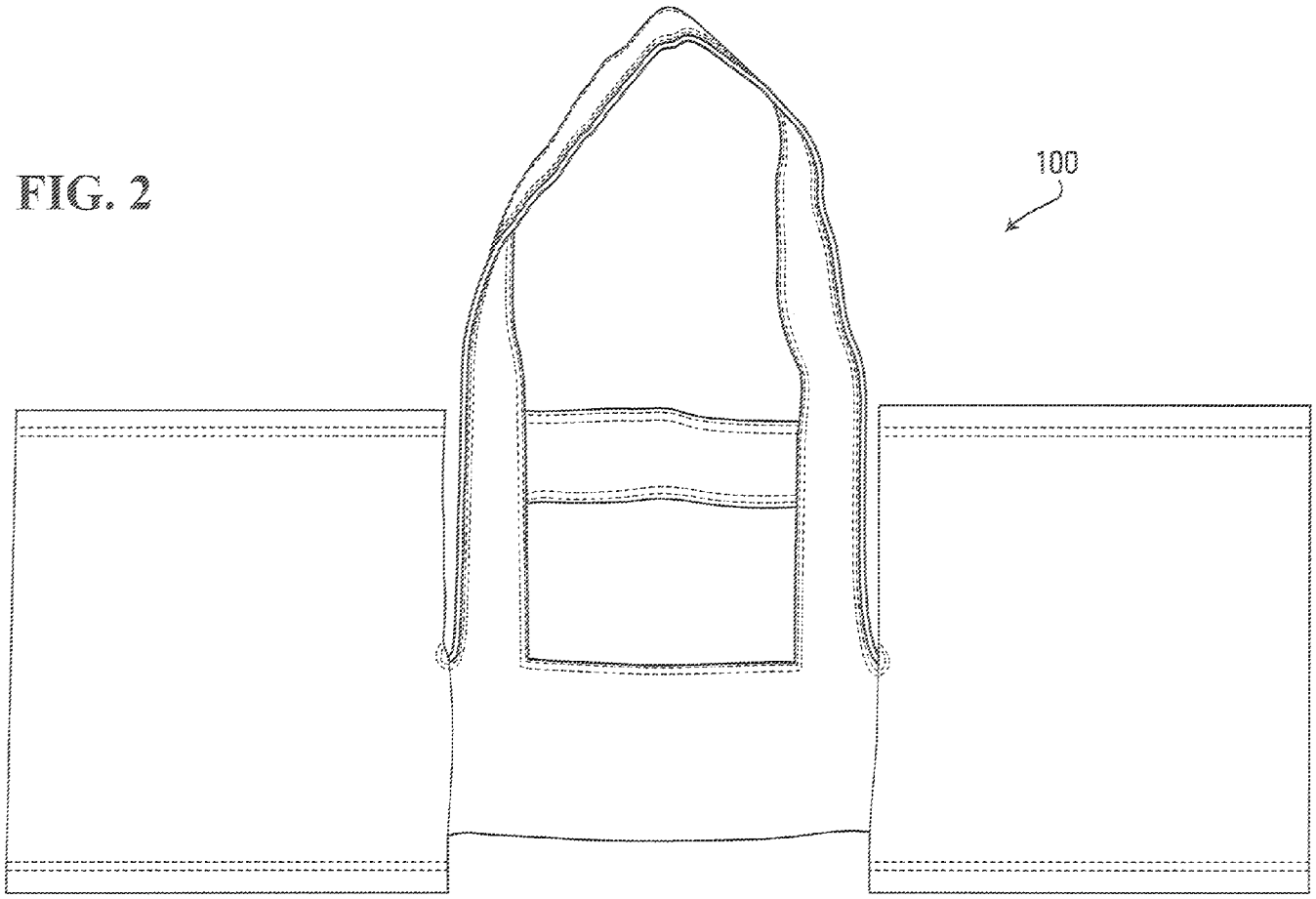
FIG. 2 is a back view of the assistive garment of FIG. 1 laid flat.

Referencing FIGS. 1 and 2, an assistive garment 100 has a pair of trouser legs 110*a*, 110*b* joined by a bridge 115. Each end 112*a*, 112*b* of the bridge 115 may be attached to one of trouser legs 110*a*, 110*b* at a point which, when the garment is worn, is a proximate a bottom of each of the trouser legs. As illustrated, each end 112*a*, 112*b* of the bridge extends between a midpoint and a bottom of a respective one of trouser legs 110*a*, 110*b*. Thus, the bridge 115 extends no higher than a midpoint of each of trouser legs 110*a*, 110*b*. A handle 130 extends from the top of the bridge and is integrally formed with the bridge. The handle includes an inverted U-shaped primary handle 140 extending from a pair of spaced points 120*a*, 120*b* along the bridge 115 proximate a respective one of trouser legs 110*a*, 110*b* so as to form a loop. Handle 130 also has a secondary handle 145 extending across the loop formed by the primary handle and joined to the primary handle at a pair of points 150*a*, 150*b* along a respective side of the primary handle 140 and proximate a respective one of trouser legs 110*a*, 110*b*.

As illustrated, when garment 100 is laid flat, primary handle 140 extends upwardly beyond an upper end of each of trouser legs 110*a*, 110*b* and secondary handle 145 is located at about the top of trouser legs 110*a*, 110*b*.

Trouser legs 110*a*, 110*b* may be made of fabric or other woven material. A suitable fabric may be one that is resistant to tearing or significant stretching during use and wear of garment 100. For example, trouser legs 110*a*, 110*b* may be made of a strong heavy fabric such as, for example, canvas, rip-stop nylon, leather, polyester, or the like. Another suitable fabric may include cotton. A blended fabric may be used such as, for example, a cotton-spandex blend. For example, a cotton-spandex blend having at least 2% spandex by weight may be used in fabricating assistive garment 100. Fabrication from a cotton-spandex blend may enhance the comfort of garment 100 when worn. A cotton-spandex blend may also be more resilient during wear than pure cotton. A garment fabricated from cotton or cotton-spandex blend may also be machine washable and/or suitable for machine drying. Alternatively, the trouser legs may be fabricated of a woven mesh. Use of a woven mesh may offer ventilation properties as compared to a more continuous material.

Bridge 115 may be fabricated from a same or similar material as that of the trouser legs 110*a*, 110*b*. Alternatively, bridge 115 may comprise one or more bands or straps joining each of trouser legs 110*a*, 110*b*. For example, bridge 115 may be fabricated of rope-like straps or strips.

Bridge 115 may be attached to each of the trouser legs 110*a*, 110*b* by way of sewing. In an alternative embodiment, bridge 115 may be integrally formed with a portion of each of the trouser legs 110*a*, 110*b*. In a further embodiment, bridge 115 may be fabricated out of multiple segments, each segment of which may or may not be connected to the others. For example, bridge 115 may comprise multiple fabric panels, each spanning trouser legs 110*a*, 110*b*, with the multiple fabric panels attached to the others of the multiple fabric panels.

As illustrated in FIGS. 1 and 2, each of trouser legs 110*a*, 110*b* is a fabric tube sewn or stitched along a seam 310 which is positioned so as to run along the inside of the legs of a wearer. This seam also joins the ends 112*a*, 112*b* of the bridge to the trouser legs.

Handle 130 may be fabricated using a same or similar material as that of the trouser legs 110*a*, 110*b* and/or bridge 115. Additionally or alternatively, handle 130 may be fabricated out of stranded material such as, for example, a rope-like material. Different components of handle 130 such as, for example, primary handle 140 and secondary handle 145 may be fabricated out of the same material or out of different materials. For example, primary handle 140 and secondary handle 145 may both be fabricated out of a suitable fabric such as those described above for use in fabrication of trouser legs 110*a*, 110*b*. In another example, primary handle 140 may be fabricated out of a suitable fabric, such as those described above, and secondary handle 145 may be fabricated out of stranded material, or vice-versa.

In some embodiments, all or a portion of handle 130 may be treated with a material to assist in gripping. For example, all or a portion of handle 130 may be rubberized.

In an alternate embodiment, each end of the handle 130 may be joined directly to the trouser legs at the ends of the bridge.

Each of the Various components of the assistive garment may be attached together by way of suitable techniques. For example, fabric components may be sewn or stitched together. Stitching may employ machine sewing techniques for attachment. For example, sewing may use conventional lock stitch techniques such as, for example, straight or zig-zag stitching. Additionally or alternatively, fabric pieces may be sewn, such as by way of a serger, using an overlook or "merrowing" stitch. Stitching may employ single or multiple threads. For example, a lock stitch may comprise a top thread and a bobbin thread. In another example, an overlook stitch may employ multiple threads. An overlook stitch employing more threads may be stronger and more resistant to failure than one employing fewer threads. Additionally or alternatively, other fabric joining techniques such as, for example, riveting, may be employed.

Garments made primarily from sewn fabric or from fabric and other softer materials may be more comfortable when worn such as, for example, during sleep than a garment with harder surfaces.

As illustrated, primary handle 140 and secondary handle 145 are each fabricated out of distinct pieces. Primary handle 140 and secondary handle 145 may be attached such as by way of one of the above described sewing or stitching techniques. Additionally or alternatively, all or a portion of primary handle 140 and secondary handle 14 may be made of the same fabric piece. With seams suitably located to join them to other components of garment 100.

All or a portion of assistive garment 100 may be made out of more than one layer of fabric. Layered fabric may improve strength and/or durability as compared to unlayered fabric. In some cases only certain parts of a garment may be layered such as, for example, if the construction of garment 100 utilizes sewing techniques that may employ layering such as for, example, French seams, lapped seams, plackets, or the like. Additionally or alternatively, interfacing may be incorporated into the interior of garment 100 such as to, for example, stiffen various portions of assistive garment 100.

Optionally, trouser legs 110 may feature fasteners on one or both sides of each trouser leg. Fasteners may make the garment easier to don such as, for example, by permitting trouser legs 110 to be placed around a wearer's legs, without requiring that each of the wearer's legs be pushed through each trouser leg, by opening the fasteners, donning garment 100, and closing the fasteners. Suitable fasteners may include, for example, strong zippers as may resist forces applied during manipulation of the limbs by way of assistive garment 100.

Figure 3:
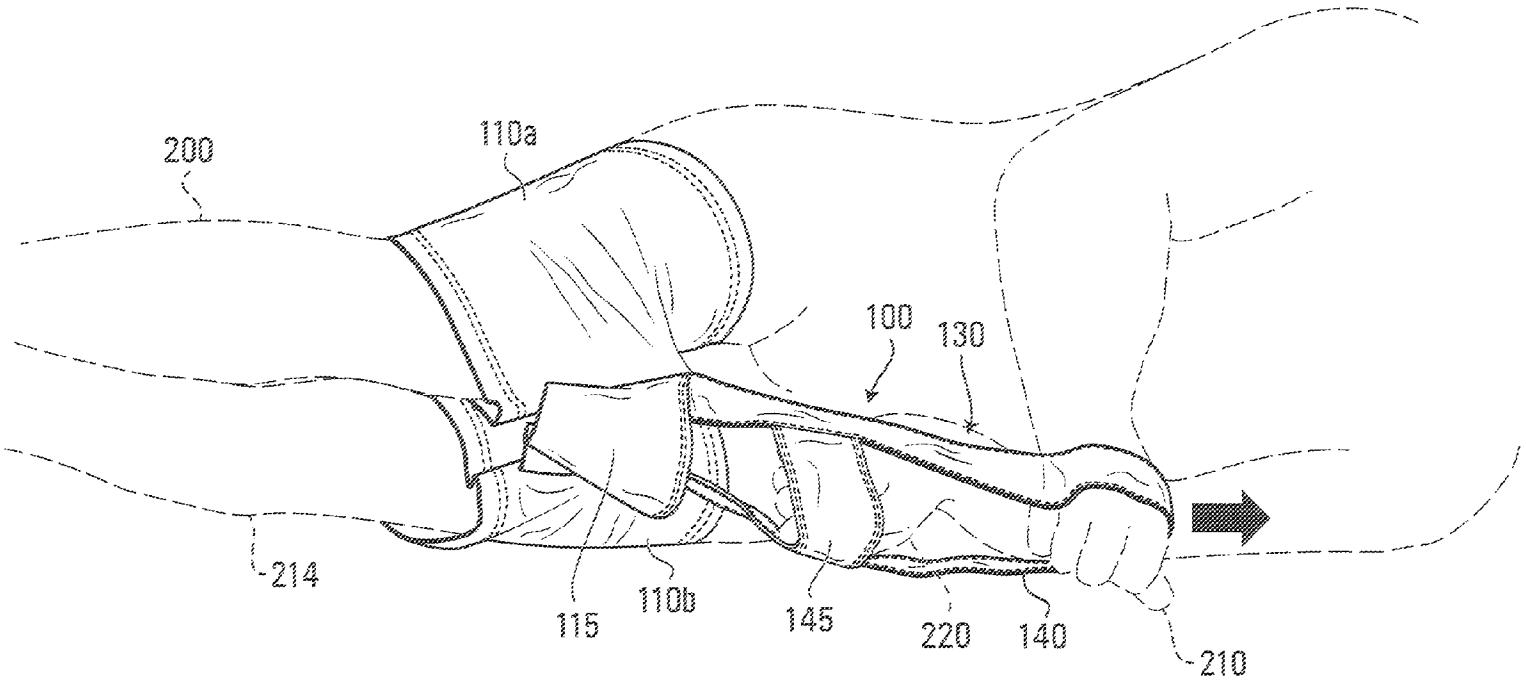
FIG. 3 is a front perspective view the assistive garment of FIG. 1 shown in use by a wearer.
Figure 4:
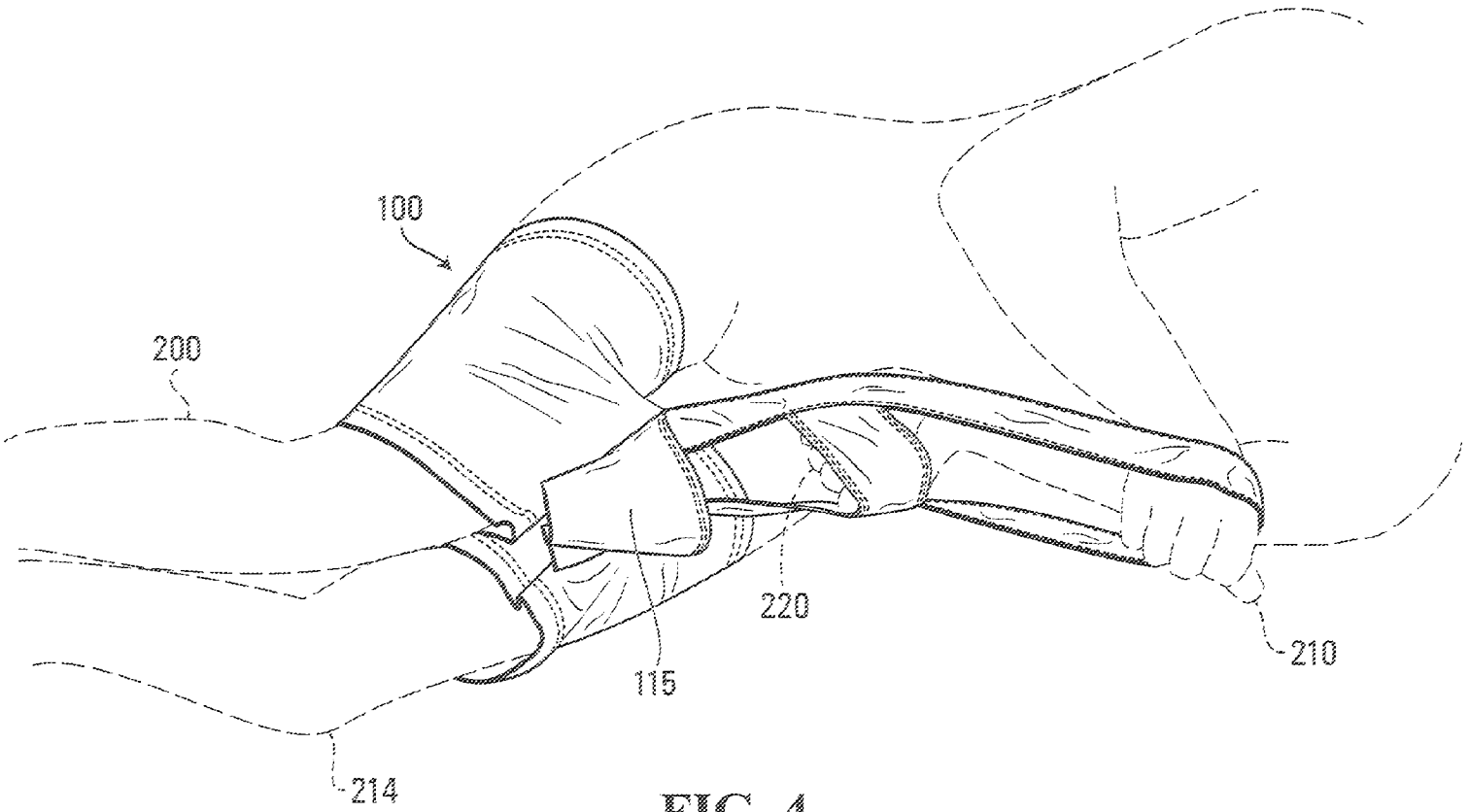
FIG. 4 is a further front perspective view of the garment of FIG. 1 shown in use by a wearer.

Referencing FIGS. 3 and 4, each trouser leg 110*a*, 110*b* is worn around a respective lower limb of a wearer so as to encircle a portion of a corresponding lower limb of the wearer. As illustrated, each trouser leg 110*a*, 110*b* is dimensioned to encompass a respective thigh of the wearer and extends from a top position on a respective thigh of the wearer down to a bottom position on a bottom portion of that thigh, the bottom position terminating above the corresponding knee 214 of the wearer.

In other embodiments, trouser legs 110*a*, 110*b* may be part of a pair of trousers that extend up to the waistline of a wearer. Additionally or alternatively, trouser legs 110*a*, 110*b* may extend below the knees of a wearer such as, for example, down to the ankles. These alternate embodiments may, however, be significantly more difficult to don for someone without full function of their lower limbs. With each embodiment, the bridge 116 may be attached to the trouser legs so that, in use, the bridge is proximate to, but above, the knees of the wearer. An attachment point closer to the knee of a wearer of assistive garment 100 may offer improved manipulation of the legs as compared to a mounting point closer to the waist. For example, such a lower attachment point may increase the effective moment arm for manipulations of garment 100 using handle 130. Further, an attachment point above the knee reduces the likelihood of injuring a knee joint while manipulating the legs with garment 100.

With reference to FIG. 3, once the garment is donned, in use, the wearer may grasp primary handle 140 with a first hand 210 and the secondary handle 145 with a second hand 220. Force may be exerted on one or both of the handles, such as for example by way of pulling or twisting movements. Such forces are transferred to bridge 115 by way of the interconnection of handle 130 with bridge 116. As trouser legs 110*a*, 110*b* encompass at least a portion of each of lower limbs 200, such forces are, in turn, be transferred to one or both of lower limbs 200. In this way, one or both of lower limbs 200 may be repositioned.

FIG. 4 is a perspective view illustrating a manipulation of the lower limbs of a wearer as may be obtained by way of the assistive garment. As illustrated, lower limbs 200 of the wearer of assistive garment 100 have been moved towards the chest of the wearer as compared to the position of the wearer in FIG. 3.

It will be apparent that bridge 115 acts as a tether between the trouser legs such that the lower limbs of a wearer both move when the handle 130 is moved. Further, even when the handle 130 is not being used by the wearer, the bridge, in concert with trouser legs 110*a*, 110*b*, acts as a tether between the legs of a wearer which limits motion of one of the legs relative to the other. In this way, certain body positions may be avoided. For example, the bridge may limit the ability of the wearer's legs to achieve positions where they are splayed apart. Conveniently, in this way, uncomfortable body positions may be limited such as, for example, during sleep.

Primary handle 140 is dimensioned so that, as illustrated, the apex of the primary handle 140 overlies the chest of a wearer when extended towards the head.

A garment equipped with secondary handle 145 may facilitate use of the garment. For example, a user could grasp the primary handle 140 with one hand and the secondary handle 145 with the other to increase the force that may be applied to the legs. Also, with the wearer's legs bent, it may be more difficult to manoeuvre the legs with the primary handle 140 as this would require the wearer to raise an arm farther than may be comfortable. Thus, in such circumstances, the wearer may prefer to use the secondary handle 145. Further, by manipulation of one of the handles 140, 145 in concert or in opposition to the other of the handles, such as by way of, for example, using a first hand 210 and a second hand 220 as illustrated, one or both of translational and rotational forces may be applied to one or both of lower limbs 200 using assistive garment 100.

With the garment, while on a bed, not only may a wearer reposition his lower limbs on the bed but also, while entering the bed, he may use the garment to assist in lifting his lower limbs onto the bed.

In some embodiments, assistive garment 100 may be made available in multiple sizes. For example, garments may be available for wearers of different height or girth. Additionally or alternatively, assistive garments may be made to measure for different wearers.

Optionally, in some embodiments, assistive garment 100 may also incorporate added elements. For example, where the garment forms trousers the garment 100 may optionally incorporate added elements such as, for example, a waistband, a pants seat, a fly, and/or the like.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. An assistive garment for aiding in reorientation of the lower limbs of a wearer, said garment comprising:

a pair of trouser legs, each trouser leg of said trouser legs being a tube with an open upper end disposed above an open lower end and dimensioned to encompass at least a portion of a respective lower limb of said wearer;

a bridge extending between said pair of trouser legs, said bridge joined to a portion proximate the bottom of the open lower end of each leg of said pair of trouser legs and extending no higher than a midpoint between said open lower end and said open upper end of said each trouser leg; and a handle extending from the top of said bridge, said handle adapted to permit manipulation of said lower limbs of said wearer by way of manipulation of said handle; wherein said handle has opposite handle ends extending from spaced points along said bridge, each handle end proximate one said trouser leg so that said handle forms a loop; and wherein said pair of trouser legs, said handle, and said bridge are fabricated of fabric.

2. The garment of claim 1, wherein each end of said bridge is joined to said each trouser leg at a point which is proximate said lower end of said each trouser leg.

3. The garment of claim 1, wherein each said trouser leg is dimensioned so as to terminate above a knee of said wearer.

4. The garment of claim 1, wherein said loop extends upwardly beyond said open upper end of said each said trouser leg.

5. The garment of claim 1, wherein said loop is dimensioned so that a distance between an apex of said loop and said open upper end of said each trouser leg is greater than a distance between said open upper end of said each trouser leg and said midpoint.

6. The garment of claim 1, wherein said loop is a primary handle and said-handle further comprises comprising a secondary handle extending across said loop from a first point proximate one said trouser leg to a second point proximate another said trouser leg.

7. The garment of claim 6, wherein said secondary handle is positioned such that said secondary handle is located at the top of said pair of trouser legs.

8. The garment of claim 1, wherein each said tube has a diameter dimensioned so as to permit said each said trouser leg to encompass a respective thigh of said wearer.

9. The garment of claim 1, wherein said fabric is a cotton-spandex blend having at least 2% spandex by mass.

10. An assistive garment for aiding in reorientation of the lower limbs of a wearer, said garment comprising:

a pair of trouser legs, each trouser leg of said trouser legs being a tube with an open upper end disposed above an open lower end and dimensioned to encompass at least a portion of a respective lower limb of said wearer;

a bridge extending between said pair of trouser legs, wherein each end of said bridge is joined to a respective said trouser leg such that each end of said bridge is disposed between a midpoint and said lower end of said each trouser leg; and a handle extending from said bridge, said handle adapted to permit manipulation of said lower limbs of said wearer by way of manipulation of said handle; wherein said handle has opposite handle ends extending from spaced points along said bridge, each handle end proximate one said trouser leg so that said handle forms a loop; wherein said pair of trouser legs, said handle, and said bridge are fabricated of fabric.

* * * * *